US009863129B2

(12) United States Patent
Lin

(10) Patent No.: US 9,863,129 B2
(45) Date of Patent: Jan. 9, 2018

(54) SEAMLESS LOCKING DRAIN CONNECTOR STRUCTURE OF METALLIC SINK

(71) Applicant: Jun-Qi Lin, Taichung (TW)

(72) Inventor: Jun-Qi Lin, Taichung (TW)

( * ) Notice: Subject to any disclaimer, the term of this patent is extended or adjusted under 35 U.S.C. 154(b) by 0 days.

(21) Appl. No.: 15/293,311

(22) Filed: Oct. 14, 2016

(65) Prior Publication Data

US 2017/0030058 A1 Feb. 2, 2017

(51) Int. Cl.

| | |
|---|---|
| ***E03C 1/182*** | (2006.01) |
| ***E03C 1/22*** | (2006.01) |
| ***E03C 1/264*** | (2006.01) |

(52) U.S. Cl.

CPC ..... *E03C 1/182* (2013.01); *E03C 1/22* (2013.01); *E03C 1/264* (2013.01)

(58) Field of Classification Search

CPC ..... E03C 1/182; E03C 1/22; E03C 1/264

USPC ..... 4/650, 679, 695

See application file for complete search history.

(56) References Cited

U.S. PATENT DOCUMENTS

| | | | | |
|---|---|---|---|---|
| 4,405,159 | A * | 9/1983 | Spelber | E03C 1/22 285/136.1 |
| 5,318,230 | A * | 6/1994 | Ferguson | E03C 1/2665 241/46.13 |
| 6,016,579 | A * | 1/2000 | Erbs | E03C 1/182 4/631 |
| 2010/0132110 | A1* | 6/2010 | Schwaegler | E03C 1/18 4/619 |
| 2012/0255117 | A1* | 10/2012 | Childs | E03C 1/182 4/679 |

* cited by examiner

*Primary Examiner* — Tuan N Nguyen

(57) ABSTRACT

A seamless locking drain connector structure of a metallic sink is provided. A water outlet of a bottom of the metallic sink is integrally formed with an annular ring extending outward from the bottom of the metallic sink. The annular ring is fixedly connected with a connecting sleeve. The connecting sleeve is formed with outer threads. An open end of a stepped trough of the drain connector is formed with a retaining rim portion relative to the bottom end of the connecting sleeve. The retaining rim portion is connected with a locking sleeve. The locking sleeve is formed with inner threads corresponding to the outer threads of the connecting sleeve. The inner threads mesh with the outer threads, such that the retaining rim portion of the drain connector is tightly locked to the bottom end of the connecting sleeve to connect with the annular ring and the water outlet.

6 Claims, 5 Drawing Sheets

SEAMLESS LOCKING DRAIN CONNECTOR STRUCTURE OF METALLIC SINK

FIELD OF THE INVENTION

The present invention relates to a seamless connecting structure for connecting a water outlet of the bottom of a metallic sink and a drain connector, and more particularly to a seamless locking drain connector structure of a metallic sink to improve the appearance of the metallic sink and to clean and maintain the metallic sink easily.

BACKGROUND OF THE INVENTION

In order to be durable, beautiful or easy for cleaning and maintenance, most kitchen sinks in the market are metallic sinks made of stainless steel. Metallic sinks are used for washing kitchen utensils, dishes, fruit or vegetables. In order to avoid a clog in the drainage pipe, the water outlet of the metallic sink is connected with a drain connector, and a filter or a mesh is provided in the drain connector to filter residues in the drainage. In consideration of the cost, the metallic sink is made by sheet metal processing techniques to form a thin casing (thin wall) body. Because the wall of the bottom of the sink is thin, it is not easy to connect a drain connector at the outlet end of the water outlet. A conventional drain connector structure is disclosed in Taiwan Utility Model Patent No. M383593 titled "a drain connector structure of a kitchen sink". The drain connector is disposed in the sink and extends out from the water outlet of the bottom of the sink. The rim of the drain connector is retained on the surface of the bottom of the sink to cooperate with a packing washer, so that the drain connector is located beneath the bottom of the sink. A locking ring is provided on an outer threaded section of the drain connector for fixing the drain connector to the water outlet. No matter how thin the packing washer is, there is still a gap between the rim of the drain connector and the surface of the bottom of the sink. There will be dirt and filth accumulated in the gap (it is easy to breed mold and bring odor). Furthermore, it is not easy for cleaning and maintenance to affect the appearance of the sink and hygiene.

SUMMARY OF THE INVENTION

The primary object of the present invention is to provide a seamless locking drain connector structure of a metallic sink. A bottom of the metallic sink is formed with a water outlet. The water outlet is connected with a drain connector. The drain connector has a stepped trough therein. A bottom end of the stepped trough has a connecting portion for connecting a drain pipe. The water outlet of the bottom of the metallic sink is integrally formed with an annular ring extending outward from the wall of the bottom. The outer periphery of the annular ring is fixedly connected with a connecting sleeve. The outer wall of the connecting sleeve is formed with outer threads. An open end of the stepped trough of the drain connector is formed with a retaining rim portion relative to the bottom end of the connecting sleeve. The outer edge of the retaining rim portion is connected with a locking sleeve. The inner wall of the locking sleeve is formed with inner threads corresponding to the outer threads of the connecting sleeve. The inner threads mesh with the outer threads of the connecting sleeve, such that the retaining rim portion of the drain connector is tightly locked to the bottom end of the connecting sleeve to connect with the annular ring and the water outlet. Through the annular ring, the appearance from the water outlet of the bottom of the metallic sink to the open end of the stepped trough of the drain connector is complete, achieving a seamless connection effect for the water outlet of the bottom of the metallic sink, such that the metallic sink is pleasing to the eyes and can be cleaned and maintained easily.

Preferably, the connecting sleeve is fixed on an outer surface of the annular ring by welding, so that the connecting sleeve is connected with the annular ring firmly.

Preferably, a strainer is provided on the retaining rim portion at the open end of the stepped trough of the drain connector. An upper end of the strainer is provided with an upper filter member for plugging the inner edge of the annular ring. The upper filter member has a filter aperture portion and a recess. The recess is provided with a sink cover for closing the filter aperture portion. When the metallic sink is filled with water, the sink cover keeps the water in the metallic sink from flowing to the drain connector. On the contrary, when the sink cover is opened, the dirty water in the metallic sink flows through the drain connector to be drained. The filter aperture portion of the upper filter member and the strainer are used to filter impurity to attain a dual-filter effect.

Preferably, a sealing washer is provided between the bottom end of the connecting sleeve and the retaining rim portion of the drain connector. When the inner threads of the locking sleeve mesh with the outer threads of the connecting sleeve, the sealing washer is compressed by the retaining rim portion through the screwed locking force of the locking sleeve to provide a tightening and sealing function, such that the drain connector is locked on the connecting sleeve, achieving the effect of preventing water leakage.

Preferably, the retaining rim portion of the drain connector is a rim. The locking sleeve is mounted on the retaining rim portion. The locking sleeve is formed with an annular brace portion relative to the retaining rim portion for bracing the lower edge of the retaining rim portion. When the inner threads of the locking sleeve mesh with the outer threads of the connecting sleeve, the annular brace portion of the locking sleeve holds the retaining rim portion of the drain connector to approach the bottom end of the connecting sleeve. During the operation to lock or unlock the locking sleeve and the connecting sleeve, the drain connector is not rotated along with the locking sleeve to complete the connection or disconnection between the retaining rim portion of the drain connector and the annular ring of the metallic sink. It is convenient for the drain connector to be assembled to or disassembled from the water outlet of the metallic sink.

Preferably, a lower end of the locking sleeve is integrally connected with the outer edge of the retaining rim portion of the drain connector. The drain connector and the locking sleeve may be integrally formed by injection molding and made of a plastic material to reduce the manufacture cost.

DESCRIPTION OF THE PREFERRED EMBODIMENTS

Embodiments of the present invention will now be described, by way of example only, with reference to the accompanying drawings.

Figure 1:
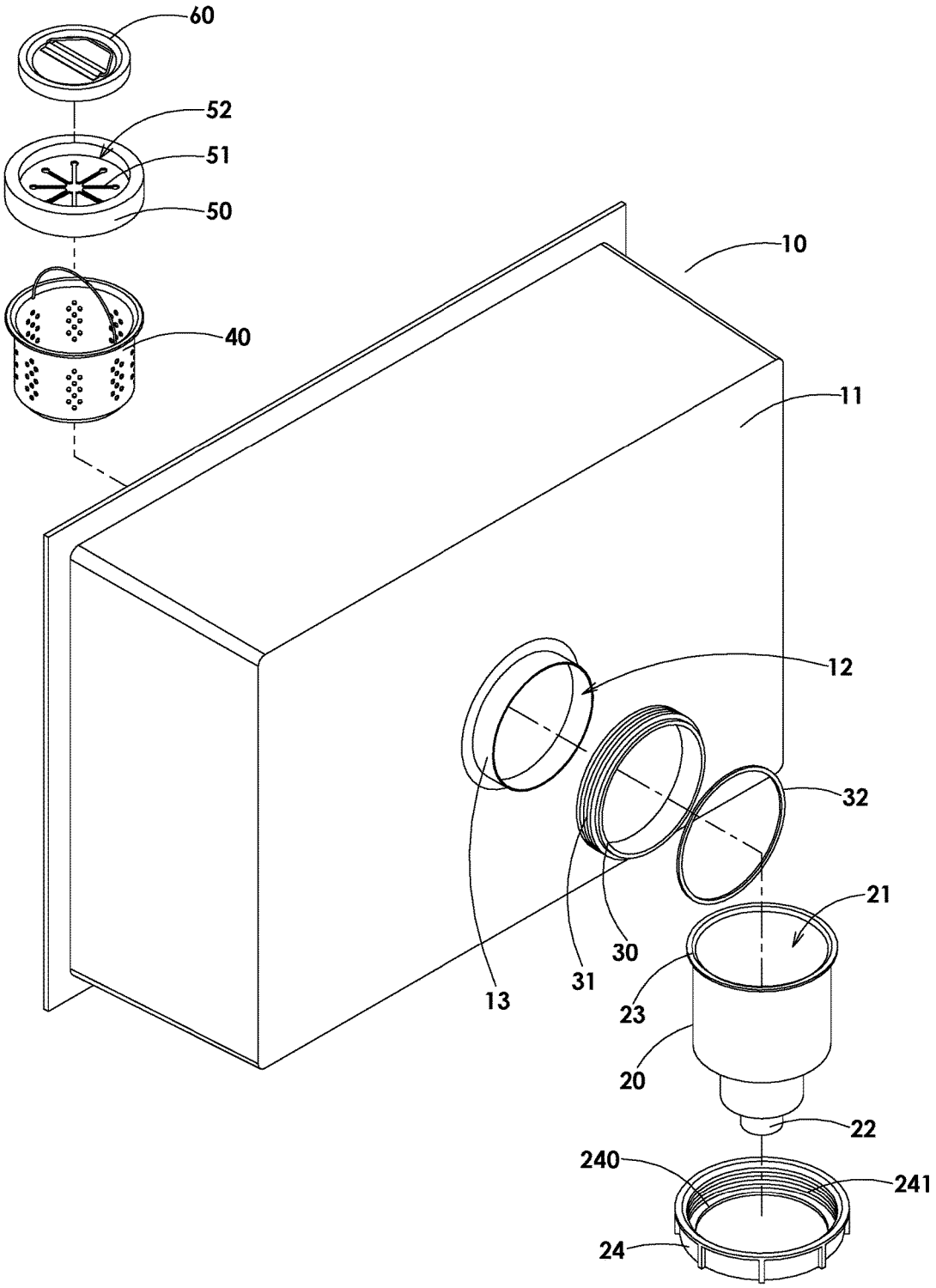
FIG. 1 is an exploded view according to a first embodiment of the present invention.
Figure 2:
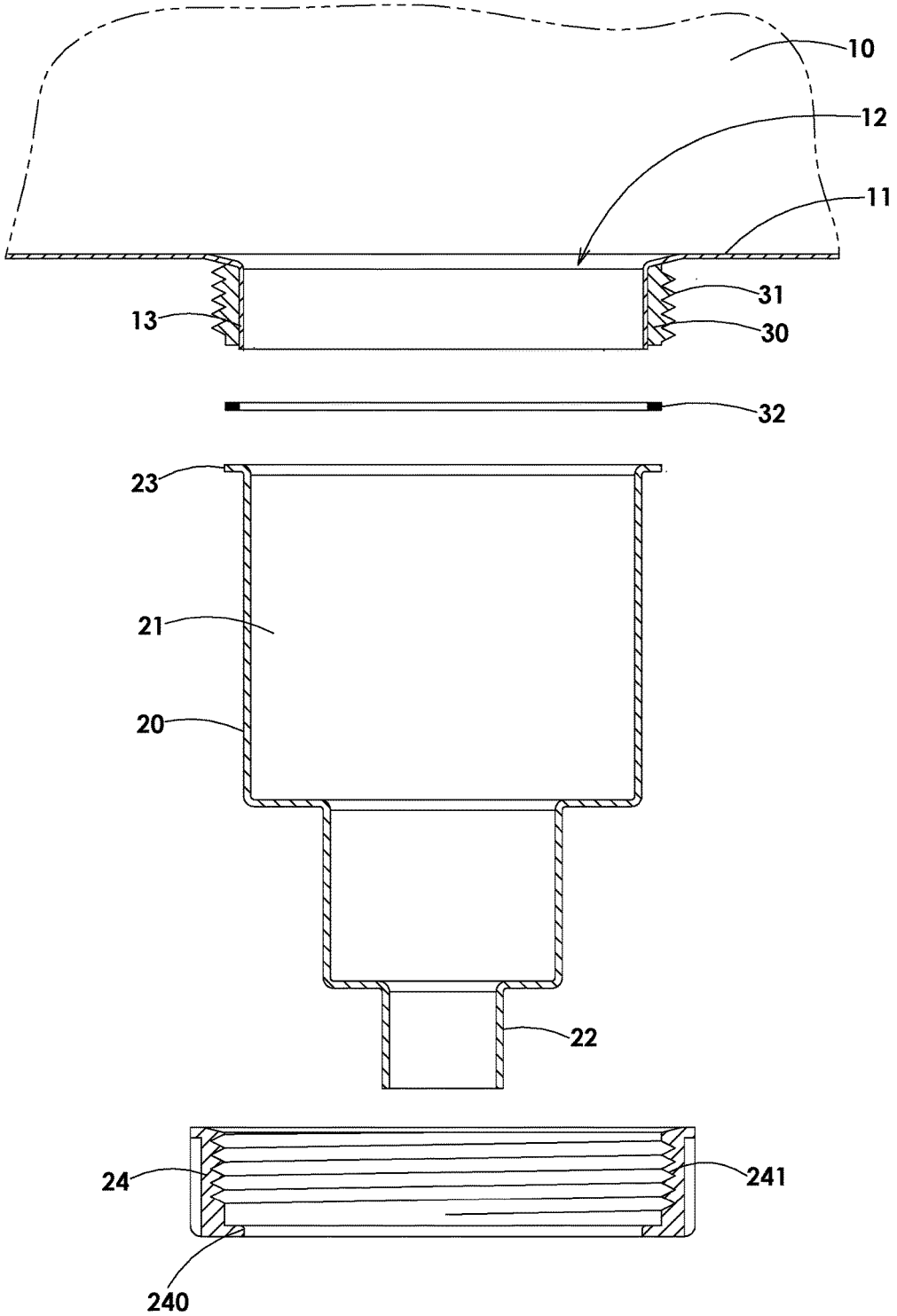
FIG. 2 is an exploded sectional view according to the first embodiment of the present invention.
Figure 3:
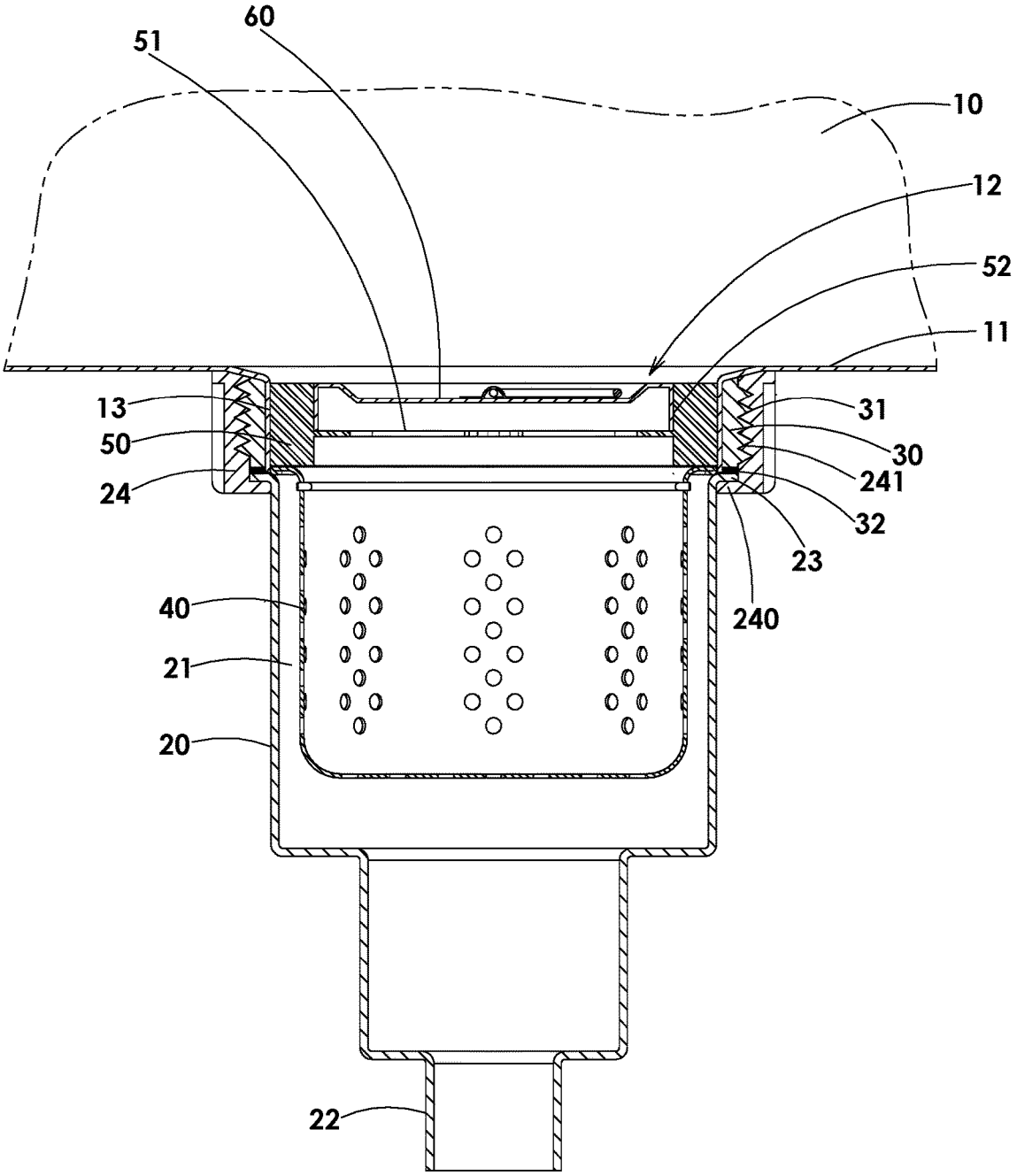
FIG. 3 is a sectional view according to the first embodiment of the present invention.

The present invention discloses a seamless locking drain connector structure of a metallic sink. As shown in FIGS. 1-3, a bottom 11 of a stainless steel metallic sink 10 is formed with a water outlet 12. The water outlet 12 is connected with a drain connector 20. The drain connector 20 has a stepped trough 21 therein. A bottom end of the stepped trough 21 has a connecting portion 22 for connecting a drain pipe (not shown in the drawings). The water outlet 12 of the bottom 11 of the metallic sink 10 is integrally formed with an annular ring 13 extending outward from the wall of the bottom 11. The outer periphery of the annular ring 13 is fixedly connected with a connecting sleeve 30. The outer wall of the connecting sleeve 30 is formed with outer threads 31. An open end of the stepped trough 21 of the drain connector 20 is formed with a retaining rim portion 23 relative to the bottom end of the connecting sleeve 30. The outer edge of the retaining rim portion 23 is connected with a locking sleeve 24. The inner wall of the locking sleeve 24 is formed with inner threads 241 corresponding to the outer threads 31 of the connecting sleeve 30. The inner threads 241 mesh with the outer threads 31 of the connecting sleeve 30, such that the retaining rim portion 23 of the drain connector 20 is tightly locked to the bottom end of the connecting sleeve 30 to connect with the annular ring 13 and the water outlet 12. As shown in FIG. 2 and FIG. 3, through the annular ring 13, the appearance from the water outlet 12 of the bottom 11 of the metallic sink 10 to the open end of the stepped trough 21 of the drain connector 20 is complete, achieving a seamless connection effect for the water outlet 12 of the bottom 11 of the metallic sink 10, such that the metallic sink 10 is pleasing to the eyes and can be cleaned and maintained easily.

According to the aforesaid embodiment, as shown in FIGS. 1-3, the connecting sleeve 30 is an annular sleeve made of a stainless steel material. The connecting sleeve 30 is fixed on an outer surface of the annular ring 13 by welding, so that the connecting sleeve 30 is connected with the annular ring 13 firmly.

According to the aforesaid embodiment, as shown in FIGS. 1-3, a strainer 40 is provided on the retaining rim portion 23 at the open end of the stepped trough 21 of the drain connector 20. An upper end of the strainer 40 is provided with an upper filter member 50 for plugging the inner edge of the annular ring 13. The upper filter member 50 has a filter aperture portion 51 and a recess 52. The recess 52 is provided with a sink cover 60 for closing the filter aperture portion 51. When the metallic sink 10 is filled with water (not shown in the drawings), the sink cover 60 keeps the water in the metallic sink 10 from flowing to the drain connector 20. On the contrary, when the sink cover 60 is opened (not shown in the drawings), the dirty water in the metallic sink 10 flows through the drain connector 20 to be drained. The filter aperture portion 51 of the upper filter member 50 and the strainer 40 are used to filter impurity to attain a dual-filter effect.

According to the aforesaid embodiment, as shown in FIGS. 1-3, a sealing washer 32 is provided between the bottom end of the connecting sleeve 30 and the retaining rim portion 23 of the drain connector 20. When the inner threads 241 of the locking sleeve 24 mesh with the outer threads 31 of the connecting sleeve 30, the sealing washer 32 is compressed by the retaining rim portion 23 through the screwed locking force of the locking sleeve 24 to provide a tightening and sealing function, such that the drain connector 20 is locked on the connecting sleeve 30, achieving the effect of preventing water leakage.

According to the aforesaid embodiment, as shown in FIGS. 1-3, the retaining rim portion 23 of the drain connector 20 is a rim. The locking sleeve 24 is mounted on the retaining rim portion 23. The locking sleeve 24 is formed with an annular brace portion 240 relative to the retaining rim portion 23 for bracing the lower edge of the retaining rim portion 23. As shown in FIG. 3, when the inner threads 241 of the locking sleeve 24 mesh with the outer threads 31 of the connecting sleeve 30, the annular brace portion 240 of the locking sleeve 24 holds the retaining rim portion 23 of the drain connector 20 to approach the bottom end of the connecting sleeve 30. During the operation to lock or unlock the locking sleeve 24 and the connecting sleeve 30, the drain connector 20 is not rotated along with the locking sleeve 24 to complete the connection or disconnection between the retaining rim portion 23 of the drain connector 20 and the annular ring 13 of the metallic sink 10. It is convenient for the drain connector 20 to be assembled to or disassembled from the water outlet 12 of the metallic sink 10.

Figure 4:
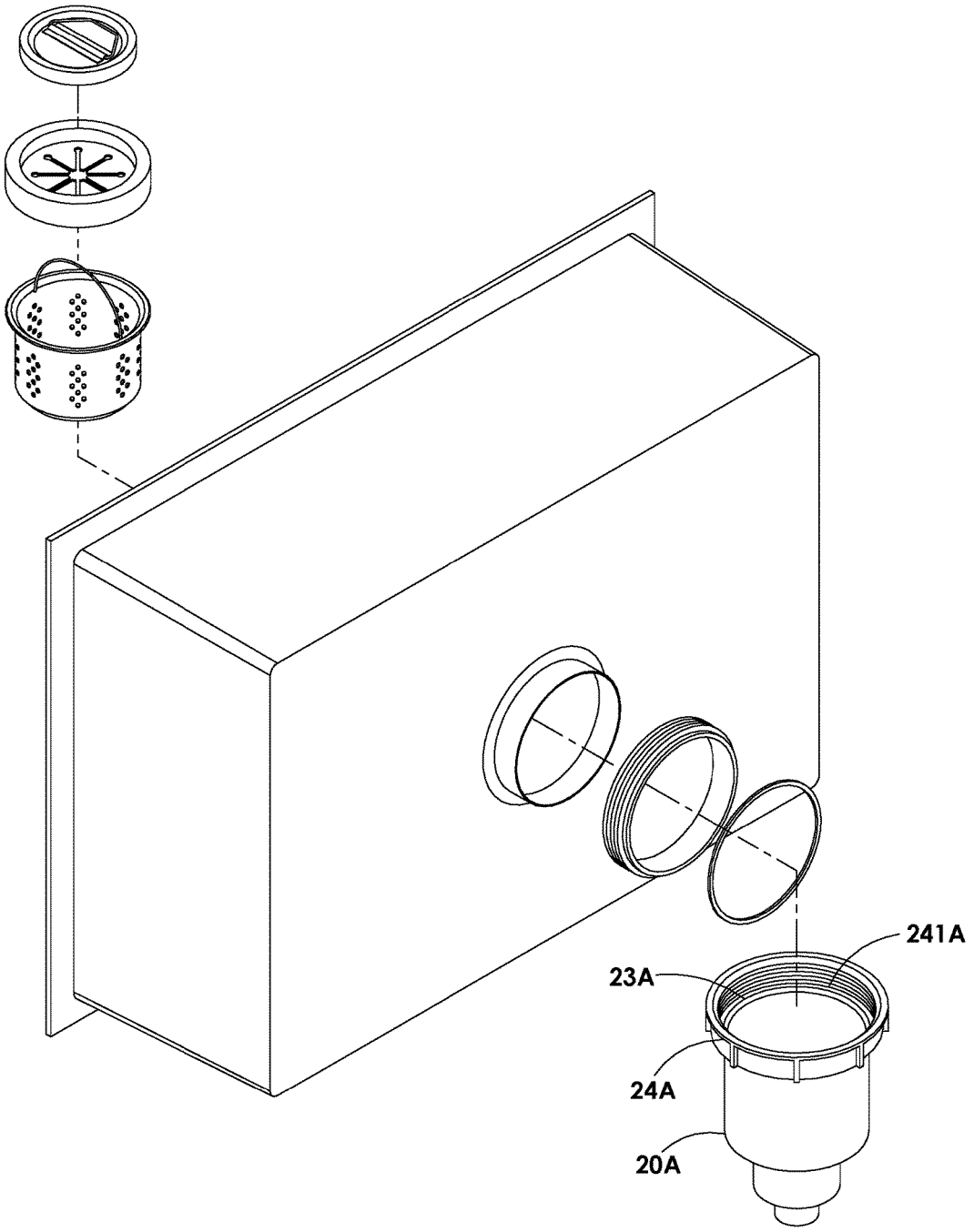
FIG. 4 is an exploded view according to a second embodiment of the present invention.
Figure 5:
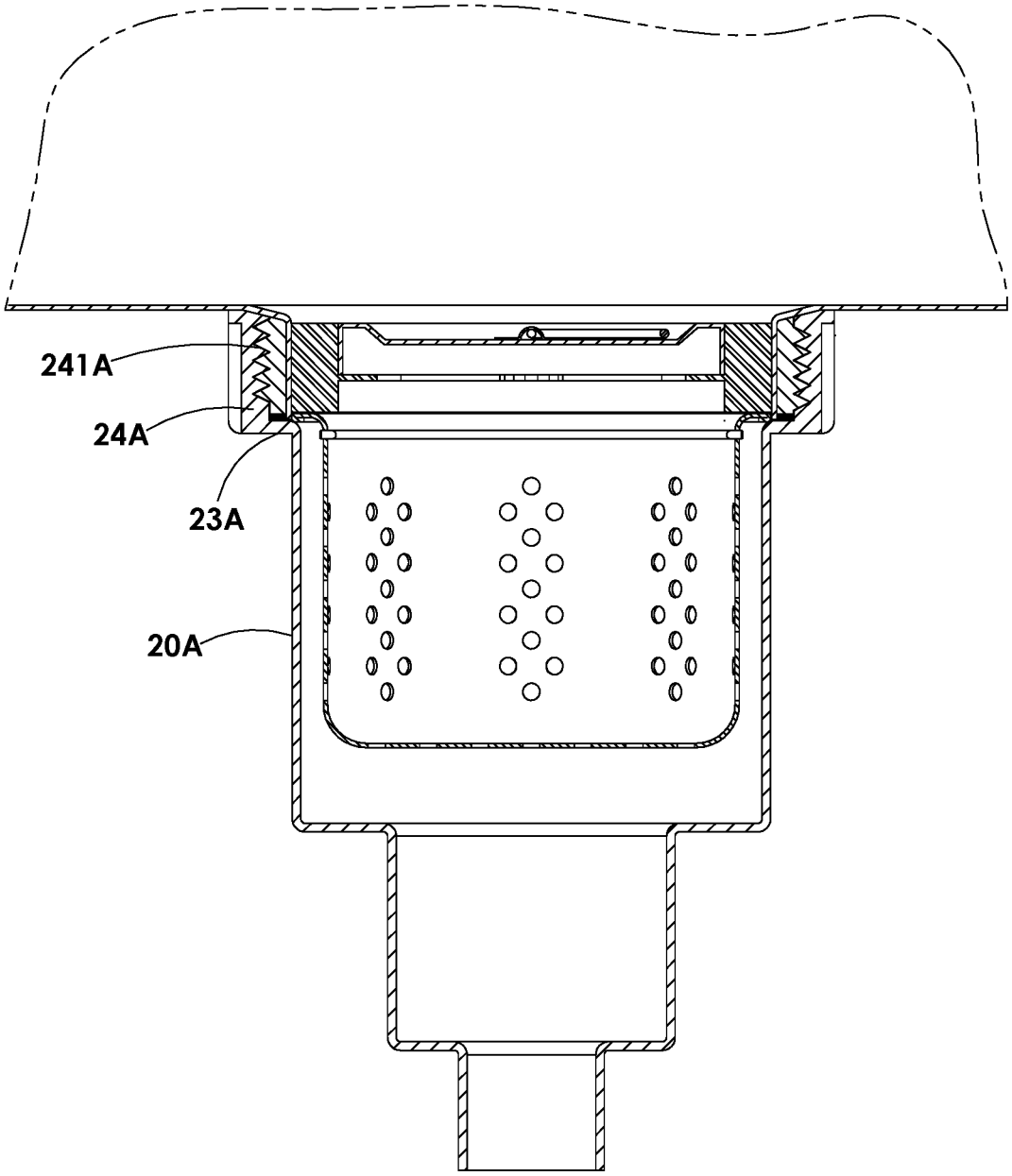
FIG. 5 is a sectional view according to the second embodiment of the present invention.

In another embodiment, as shown in FIG. 4 and FIG. 5, the locking sleeve 24A has the inner threads 241A. A lower end of the locking sleeve 24A is integrally connected with the outer edge of the retaining rim portion 23A of the drain connector 20A. The drain connector 20A and the locking sleeve 24A may be integrally formed by injection molding and made of a plastic material to reduce the manufacture cost.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A seamless locking drain connector structure of a metallic sink, a bottom of the metallic sink being formed with a water outlet; the water outlet being connected with a drain connector, the drain connector having a stepped trough therein, a bottom end of the stepped trough having a connecting portion for connecting a drain pipe; characterized by: the water outlet of the bottom of the metallic sink being integrally formed with an annular ring extending outward from a wall of the bottom, an outer periphery of the annular ring being fixedly connected with a connecting sleeve, an outer wall of the connecting sleeve being formed with outer threads, an open end of the stepped trough of the drain connector being formed with a retaining rim portion relative to a bottom end of the connecting sleeve, an outer edge of the retaining rim portion being connected with a locking sleeve, an inner wall of the locking sleeve being formed with inner threads corresponding to the outer threads of the connecting sleeve, the inner threads meshing with the outer threads of the connecting sleeve, the retaining rim portion of the drain connector being tightly locked to the bottom end of the connecting sleeve to connect with the annular ring and the water outlet.

2. The seamless locking drain connector structure of a metallic sink as claimed in claim 1, wherein the connecting sleeve is fixed on an outer surface of the annular ring by welding.

3. The seamless locking drain connector structure of a metallic sink as claimed in claim 1, wherein a strainer is provided on the retaining rim portion at the open end of the stepped trough of the drain connector, an upper end of the strainer is provided with an upper filter member for plugging an inner edge of the annular ring, the upper filter member has a filter aperture portion and a recess, and the recess is provided with a sink cover for closing the filter aperture portion.

4. The seamless locking drain connector structure of a metallic sink as claimed in claim 1, wherein a sealing washer is provided between the bottom end of the connecting sleeve and the retaining rim portion of the drain connector.

5. The seamless locking drain connector structure of a metallic sink as claimed in claim 1, wherein the retaining rim portion of the drain connector is a rim, the locking sleeve is mounted on the retaining rim portion, the locking sleeve is formed with an annular brace portion relative to the retaining rim portion for bracing an lower edge of the retaining rim portion.

6. The seamless locking drain connector structure of a metallic sink as claimed in claim 1, wherein a lower end of the locking sleeve is integrally connected with the outer edge of the retaining rim portion of the drain connector.

* * * * *